US005509532A

United States Patent [19]

Brody

[11] Patent Number: 5,509,532

[45] Date of Patent: Apr. 23, 1996

[54] FOLDABLE DISPLAY CARD FOR BUTTERFLY-MOLDED ITEM

[75] Inventor: Harvey Brody, Costa Mesa, Calif.

[73] Assignee: Delshar Industries, Inc., Santa Ana, Calif.

[21] Appl. No.: 378,623

[22] Filed: Jan. 26, 1995

Related U.S. Application Data

[63] Continuation-in-part of Ser. No. 253,369, Jun. 3, 1994, abandoned.

[51] Int. Cl.[6] ..... A45C 11/26

[52] U.S. Cl. ..... 206/349; 206/461; 206/464; 206/493; 206/806

[58] Field of Search ..... 206/481, 480, 206/477, 478, 482, 483, 485, 486, 487, 489, 490, 806, 586, 493, 495, 461, 462, 464, 349

[56] References Cited

U.S. PATENT DOCUMENTS

| | | | |
|---|---|---|---|
| 1,602,440 | 10/1926 | Lowenthal | 206/490 |
| 3,026,639 | 3/1962 | Lille | 40/10 |
| 3,116,829 | 1/1964 | Pacelli | 206/461 |
| 3,370,733 | 2/1968 | Giesler | 215/100 |
| 3,408,758 | 11/1968 | Doring | 206/493 |
| 3,957,196 | 5/1976 | Kellerman | 206/586 |
| 4,558,783 | 12/1985 | Dangerfield et al. | 206/490 |
| 4,887,709 | 12/1989 | Shimamine | 206/495 |
| 4,899,882 | 2/1990 | Benner | 206/470 |
| 5,176,257 | 1/1993 | Levy | 206/478 |

*Primary Examiner*—David T. Fidei
*Attorney, Agent, or Firm*—Klein & Szekeres

[57] ABSTRACT

A display card for holding an item attached to the card for display has a flat surface defining a top edge and a bottom edge, wherein the item is a butterfly-molded item having an integral hinge joining a pair of molded item halves that are foldable along the hinge, wherein the card includes a pair of opposed, inwardly-pointed attachment fingers defined by a notch that interrupts the bottom edge, one of the fingers being a foldable finger that is foldable along an angled crease between a folded position directed away from the notch and an extended position directed toward the other finger, whereby, when the foldable finger is in its extended position, the fingers are disposed and oriented so as to be capable of being removably captured between the item halves under the integral hinge, with a portion of the item fitting in the notch when the item is folded with the fingers disposed between the item halves. The card also includes a first substantially linear crease formed near and substantially parallel to the bottom edge, and a second substantially linear crease formed near and substantially parallel to the first crease. The first and second creases allow the card, when attached to the item, to be folded into a configuration in which a substantial portion of the flat surface overlies the item, thereby allowing the item and the attached card to be stored in almost the same amount of space as the item alone would occupy.

33 Claims, 3 Drawing Sheets

FOLDABLE DISPLAY CARD FOR BUTTERFLY-MOLDED ITEM

CROSS-REFERENCE TO RELATED APPLICATION

This application is a Continuation-In-Part of application Ser. No. 08/253,369; filed Jun. 3, 1994, now abandoned.

BACKGROUND OF THE INVENTION

This invention relates to the field of devices for displaying consumer items and articles for such purposes as retail sales. More specifically, it relates to an improved display card for removably holding an item, so that the item can be displayed from a store rack or the like.

Display cards are well-known devices for displaying consumer items for sale in a store. One typical kind of display card comprises a flat piece of cardboard, having a surface on which information (such as the item's brand name or trademark, and the identity and location of its manufacturer and/or distributor) can be printed. Means are provided, either integrally with the card, or separately (e.g., staples, elastic bands) for removably attaching the item to the bottom of the card. One or more apertures may typically be provided near the top of the card to accommodate a rod extending laterally from the rod-type of display rack.

A disadvantage of such prior art display cards is the amount of space they take up when they are shipped or stored with the items attached. Thus, a shipping or storage container must have an interior capacity sufficient not only for the actual items, but also for the additional space taken up by the display cards. This wasteful and inefficient use of space increases shipping and storage costs.

One approach to solving this problem is simply to reduce the size of the display cards, but this obviously impairs their primary function of displaying the goods so as to be attractive to buyers.

Another disadvantage of prior art display cards is that they are not self-attachable to the item to be displayed on the card, thereby requiring the additional cost and inconvenience of such attachment means or structure as staples, elastic bands, or adhesively-attached clear plastic bubbles.

There has thus been a long-felt, but as yet unsatisfied need for a display card that can occupy little space in shipping or storage, without compromising its primary purpose of providing an attractive and informative display. Additionally, there has been a need for such a space-saving display card that is also self-attachable to the item to be displayed.

SUMMARY OF THE INVENTION

Broadly, the present invention is a display card that (a) converts from a folded configuration, for shipping and storage with an item attached to it, to an unfolded configuration, for displaying the item attached to it; and (b) is self-attachable to the item to be displayed.

More specifically, the present invention is an improved display card for holding an item for display, of the type including a flat surface of sufficient size for the printing thereon of the desired textual, pictorial, and/or graphic information pertaining to the item, the surface defining a top edge and a bottom edge; first means for removably attaching the item near the bottom edge; and second means near the top edge for removably holding the card on a typical display rack; wherein the improvement comprises hinge means, near the bottom edge, for allowing the card to be selectively folded into the folded configuration, in which the card overlies the item for shipping and storage, and for allowing the card to be selectively restored to the unfolded configuration for display.

The hinge means comprises first and second substantially parallel linear creases in the card proximate and parallel to the bottom edge, whereby the card is foldable along the first crease to an intermediate position that is substantially perpendicular to the plane defined by the card in the unfolded configuration, and then foldable along the second crease to the folded configuration, wherein the card overlies the item in a position that is substantially parallel to the plane defined by the card in its unfolded configuration.

The specific embodiments disclosed herein are configured for self-attachment to a molded plastic item manufactured in a "butterfly" configuration, wherein the item includes two halves joined at an integral "living" hinge. Accordingly, the specific embodiments of the invention also include attachment means, integral with the card and contiguous with the bottom edge, for self-attachment of the card to the item by being captured between the item halves at the integral hinge. The attachment means comprises a shallow, substantially trapezoidal, notch in the bottom edge of the card, the notch defining a pair of opposed, inwardly-pointed fingers. The hinged edge of the item fits in the notch, while the fingers are captured between the item halves, just under the integral hinge, when the item halves are folded together with the fingers between them.

In a specific preferred embodiment, one of the fingers is fixed, while the other is foldable away from the notch to facilitate the attachment of the item to card. Specifically, while the item is unfolded, and while the foldable finger is folded away from the notch, the fixed finger is inserted under the integral hinge of the item, and the hinged edge of the item is seated in the notch. The foldable finger is then unfolded to extend under the integral hinge. Finally, the item halves are folded together, capturing both fingers between them.

The improved display card of the present invention offers the advantage of significant space savings, as compared with conventional display cards, when folded into its folded configuration for shipping or storage, yet it does so without sacrificing display area when unfolded. Indeed, when the card is in the folded configuration, the total space occupied by the item and the card together is only slightly greater than the amount of space occupied by the item alone. Thus, the items, with the cards attached, can easily be stacked in a container in a "dense pack" configuration for optimum usage of storage space. Indeed, the same size container can usually be used for the items with the cards attached as would be used for the same number of items without the cards attached.

In addition, the display card in accordance with the present invention is readily and easily self-attachable to "butterfly" molded items, without the expense and inconvenience of separate attachment means.

Furthermore, the improved display card of the present invention is easily and inexpensively made, requiring no additional components as compared to conventional display cards, and requiring a minimum of additional manufacturing steps.

These and other advantages of the present invention will be more readily appreciated from the detailed description that follows.

DETAILED DESCRIPTION OF THE INVENTION

Figure 1:
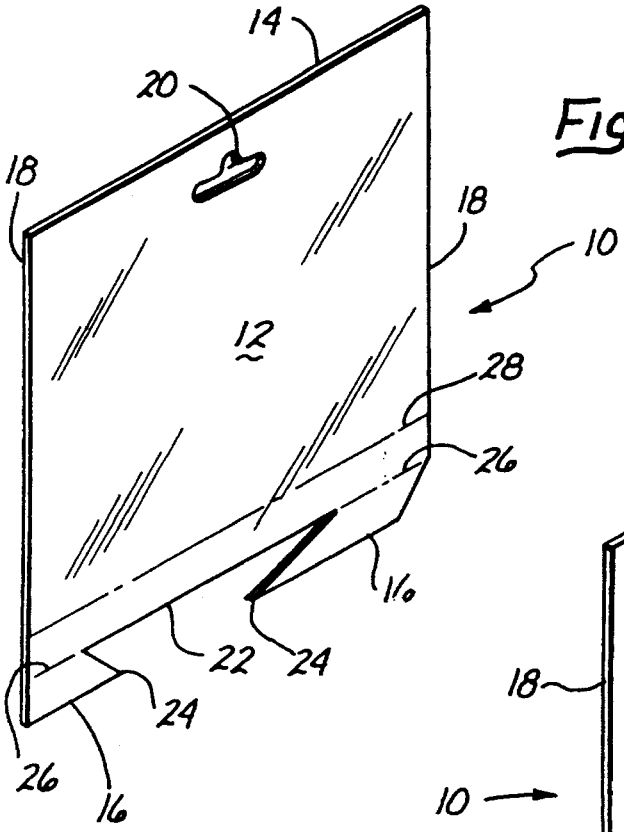
FIG. 1 is a perspective view of an improved display card, in accordance with a first embodiment of the present invention.

Referring first to FIG. 1, a foldable display card 10, in accordance with a first embodiment of the present invention, is shown. The card 10 comprises a flat piece of cardboard, having a front surface 12 defined between a top edge 14, a bottom edge 16, and a pair of opposed side edges 18. The front surface 12 has an area sufficient for the printing thereon of any desired textual, pictorial, and/or graphic information (not shown), as is the practice with conventional display cards. Alternatively, an adhesive label (not shown), printed with such information, may be applied to the front surface 12.

The configuration of the card 10 shown in the drawings is substantially rectangular, but this configuration is exemplary only. It may be any arbitrary shape, except for the configuration of the bottom edge 16 (as will be explained below), and thus the terms "top edge" and "side edge" are employed merely for orientation purposes and to define the front surface 12 as being of finite dimensions.

An aperture 20 is advantageously provided near the top edge 14. The aperture 20 is configured to receive the lateral holding element (not shown) extending from a display rack (not shown) of conventional design, whether the holding element is configured as a single or double rod. The aperture 20 may be omitted if the card 10 is to be held on a clip-type rack (not shown).

The bottom edge 16 is interrupted by a relatively shallow trapezoidal notch 22, so as to define a pair of opposed, inwardly-pointed attachment fingers 24, which are thus integral with the body of the card 10, and contiguous with the bottom edge 16. Viewed another way, each of the fingers 24 defines both a portion of the bottom edge 16 and one of the non-parallel sides of the trapezoidal notch 22. The purpose of the attachment fingers 24 will be described below.

A first horizontal linear crease 26 is formed in the card proximate and substantially parallel to the bottom edge 16, and preferably contiguous with the top edge of the notch 22, so as to be interrupted by the notch 22, thereby defining the upper limit of each of the fingers 24. (Each of the fingers 24 is thus defined between a portion of the bottom edge 16 and a portion of the first linear crease 26.) A short distance upwardly from the first linear crease 26, and substantially parallel thereto, a second horizontal linear crease 28 is formed in the card 10. Together, the first linear crease 26 and the second linear crease 28 form hinge means that allow the card 10 to be folded and unfolded, as will be described below.

Figure 2:
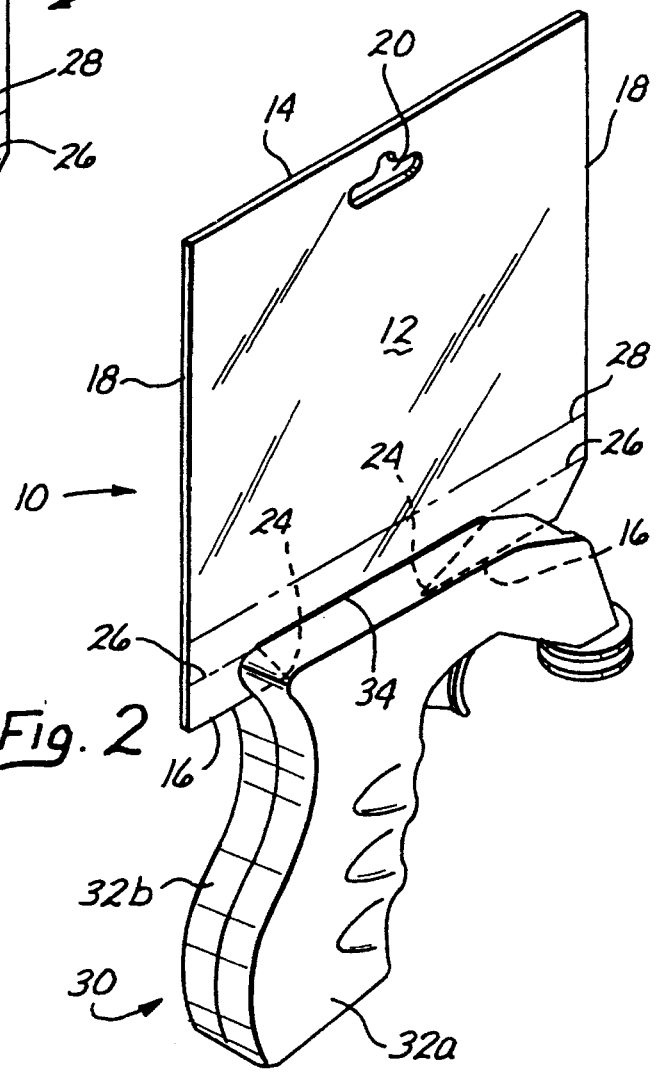
FIG. 2 is a view similar to that of FIG. 1, but showing the card attached to an item for display.
Figure 3:
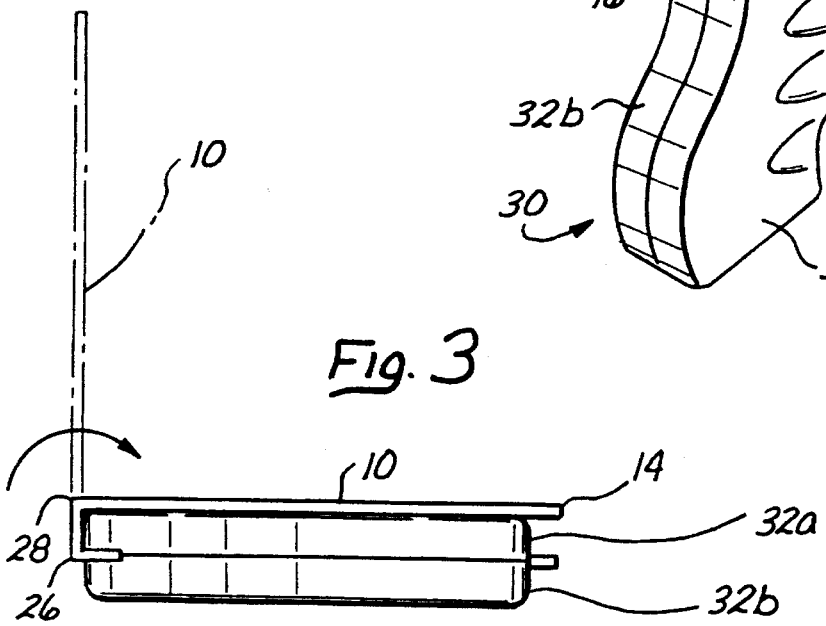
FIG. 3 is a side elevational view, taken from the left side of FIG. 2, showing the steps in the folding of the card from its unfolded configuration to its folded configuration.
Figure 5:
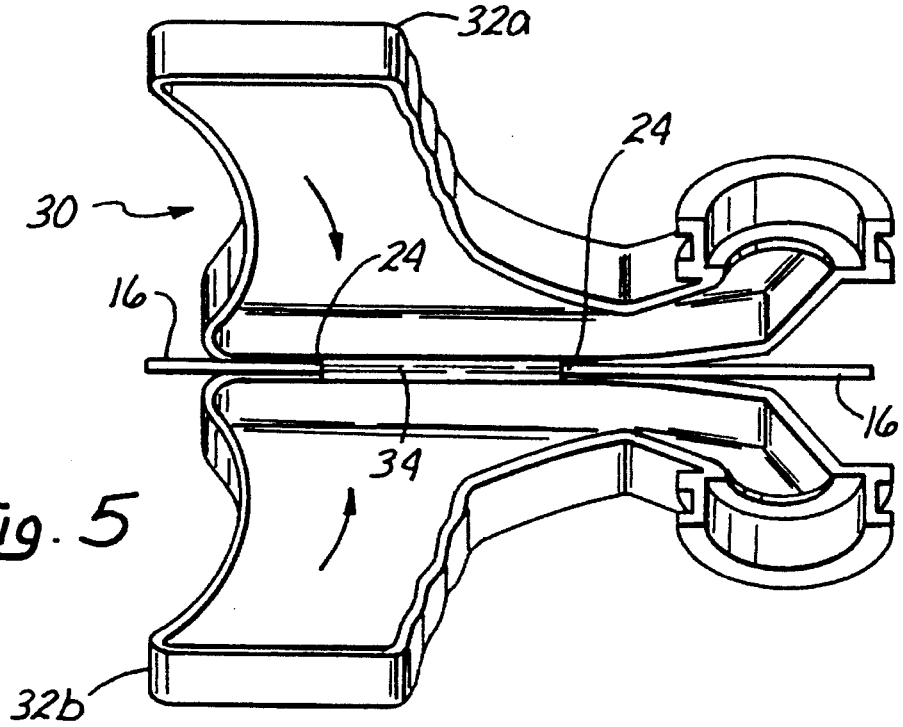
FIG. 5 is a perspective view, looking upwardly toward the bottom of the card, showing the attachment of the card to a "butterfly" molded item.

As shown in FIGS. 2, 3, and 5, the card 10 can be attached to a consumer item 30, so that the item can be displayed from a conventional display rack (not shown). The item 30 may be virtually any type of consumer item that can be conveniently packaged for display on such a rack, the item illustrated in the drawings being exemplary only. In the illustrated example (as best shown in FIG. 5), the item 30 is a plastic item, manufactured in a "butterfly" mold, so that it is formed in two halves **32*a*, 32*b*, joined by an integral "living" hinge 34, along which the halves 32*a*, 32*b*** are folded.

An item of the "butterfly" molded type is very well-suited for attachment to the card 10, since the inwardly-pointed fingers 24 function as attachment means that can be captured between the halves **32*a*, 32*b*, just under the integral hinge 34, when the item halves 32*a*, 32*b* are folded together with the fingers 24 between them. The upper portion of the item 30 thereby fits in the notch 22 in the bottom edge 16 of the card 10. The attachment fingers 24 thus allow the item 30 to be securely attached to the card 10 for display, yet they allow the item 30 to be easily removed from the card 10 by the purchaser. Furthermore, the attachment fingers 24**, being integral with the card itself, require no additional attachment means or devices (e.g., staples, elastic bands, or adhesively-attached clear plastic bubbles), thereby simplifying and economizing the packaging of the item.

Items other than those with a living hinge 34 can be similarly attached to the card 10 by the attachment fingers 24, as long as there are portions of the item that can be engaged by the fingers 24.

FIG. 3 shows the steps in the folding of the card 10 through the use of the hinge means (the creases 26, 28). First, as shown in the dotted outline, the card 10 is folded along the first linear crease 26 to bring the card to an intermediate position that is substantially perpendicular to the plane it defines in its unfolded configuration (FIGS. 1 and 2). Then, as shown in the solid outline, the card 10 is folded along the second linear crease 28 to its folded configuration, wherein a substantial portion of the flat surface 12 of the card 10 overlies the item 30 in a position that is substantially parallel to the plane defined by the card 10 in its unfolded configuration. From FIG. 3, it can also be seen that the distance between the first linear crease 26 and the second linear crease 28 should be approximately equal to, or slightly greater than, the thickness of the adjacently underlying item half **32*a*. (Of course, the card 10 can be made to fold in the opposite direction so as to overlie the other item half 32*b***.)

Figure 4:
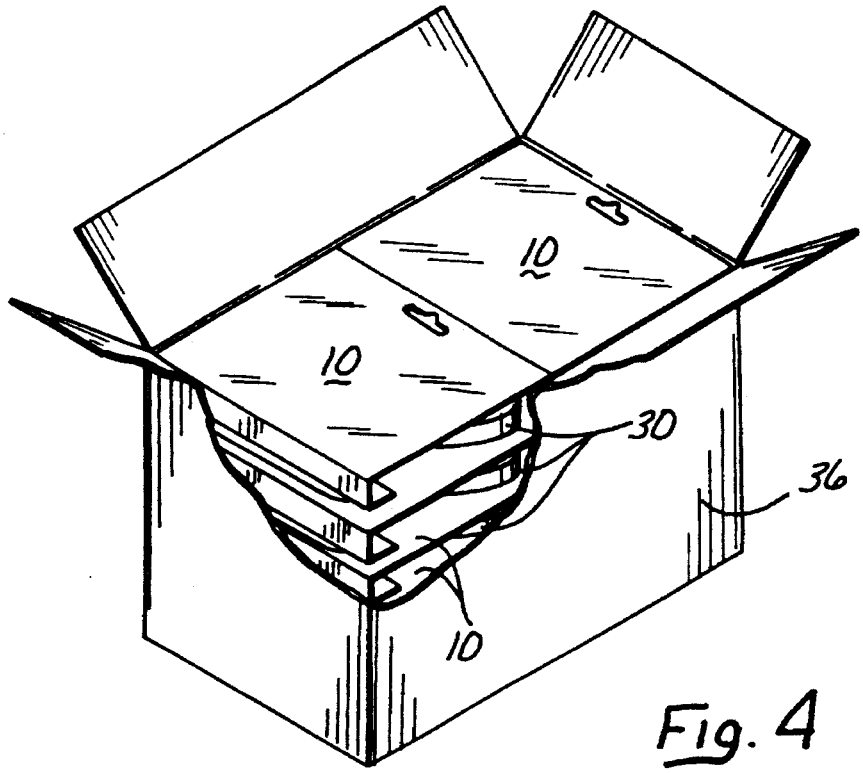
FIG. 4 is a perspective view, partially broken away, showing a plurality of display cards with items attached, as packed in a box with the display cards in the folded configuration.

FIG. 3 also shows that, with the card 10 folded flat against the item 30, the card 10 and the item 30 together occupy only slightly more space than would the item alone. This space-saving feature allows a much larger number of items to be packed in a given volume than if the cards 10 could not be folded. This is illustrated in FIG. 4, in which a container or box 36 is shown containing a number of items 30 with attached display cards 10. The cards 10 are in the their folded configurations, allowing the item/card assemblies to be closely stacked together in the box 36, in a so-called "dense pack" configuration, for optimum usage of the space within the box 36. Indeed, the same size container or box 36 can usually be used for the items with the cards attached as would be used for the same number of items without the cards attached.

Figure 6:
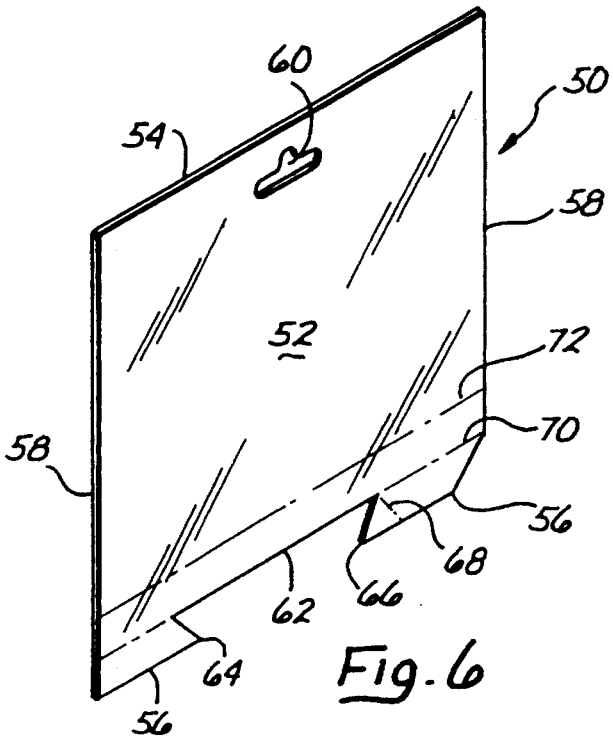
FIG. 6 is a perspective view of a display card in accordance with a preferred embodiment of the invention.
Figure 7:
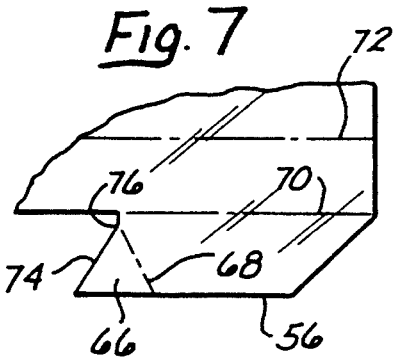
FIG. 7 is a detailed elevational view of the foldable finger of the preferred embodiment of FIG. 6, showing the finger in its unfolded position.
Figure 8:
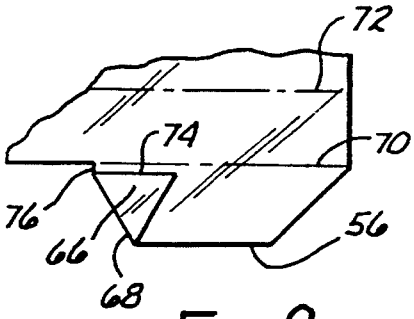
FIG. 8 is a detailed elevational view of the foldable finger of the preferred embodiment of FIG. 6, showing the finger in its folded position.

FIGS. 6, 7, and 8 illustrate a foldable display card 50, in accordance with a second embodiment of the present invention. This second embodiment is considered an improvement over the above-described first embodiment, and thus may be considered the preferred embodiment.

As in the first embodiment, the card 50 comprises a flat piece of cardboard, having a front surface 52 defined between a top edge 54, a bottom edge 56, and a pair of opposed side edges 58. An aperture 60 may be provided near the top edge, for the purposes previously described.

The bottom edge 56 is interrupted by a relatively shallow trapezoidal notch 62, so as to define first and second opposed, inwardly-pointed attachment fingers 64, 66, respectively, which are thus integral with the body of the card 50, and contiguous with the bottom edge 56. Each of the fingers 64, 66 thus defines both a portion of the bottom edge 56 and one of the non-parallel sides of the trapezoidal notch 62. The first finger 64 is fixed, while the second finger 66 is foldable away from the notch 62 along an angled fold line or crease 68, as will be described in more detail below.

A first horizontal linear crease 70 is formed in the card proximate and substantially parallel to the bottom edge 56, and preferably contiguous with the top edge of the notch 62, so as to be interrupted by the notch 62, thereby defining the upper limit of each of the fingers 64, 66. (Each of the fingers 64, 66 is thus defined between a portion of the bottom edge 56 and a portion of the first linear crease 70.) A short distance upwardly from the first linear crease 70, and substantially parallel thereto, a second horizontal linear crease 72 is formed in the card 50. Together, the first linear crease 70 and the second linear crease 72 form hinge means that allow the card 50 to be folded and unfolded, as described above.

The foldable finger 66 is movable between an extended position (FIG. 7), in which it is directed toward the notch 62 and the fixed finger 64; and a folded position (FIG. 8), in which its directed away from the notch 62. As best shown in FIGS. 7 and 8, the foldable finger 66 includes an angled edge 74 that defines one of the non-parallel sides of the trapezoidal notch 62. The upper end point of the angled edge 74 is spaced from the first linear crease 70 by a short vertical edge 76. The angled crease 68, having an upper end point that is coincident with the upper end point of the angled edge 74, is oriented at an angle that allows the angled edge 74 of the foldable finger 66, when the foldable finger 66 is folded away from the notch 62, to be oriented substantially parallel to the bottom edge 56 and the first linear crease 70, and to be spaced from the first linear crease 70 by a distance that is substantially equal to the length of the short vertical edge 76.

Figure 9:
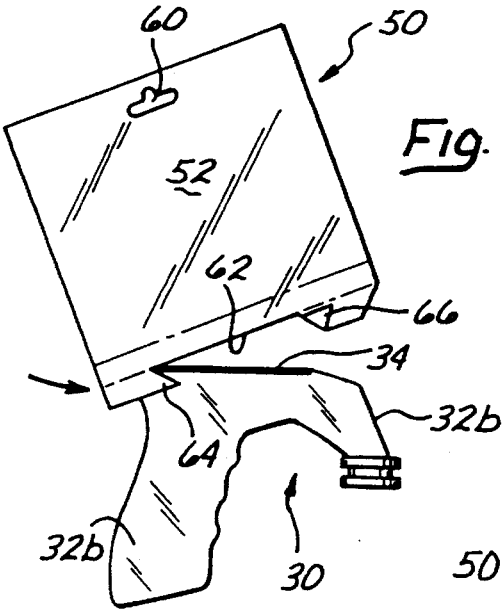
FIGS. 9, 10, and 11 are elevational views showing the steps employed in attaching a display card, in accordance with the preferred embodiment of FIG. 6, to a "butterfly" molded item.
Figure 10:
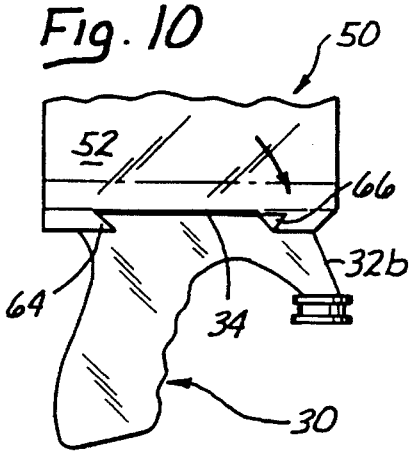
Figure 11:
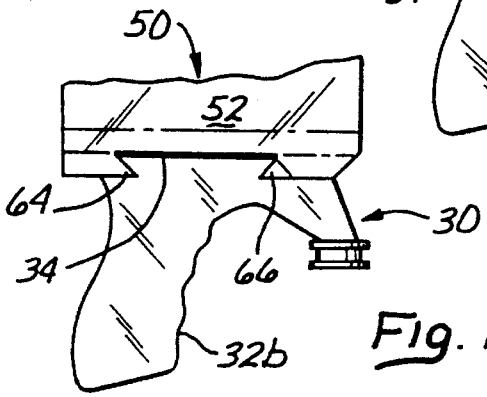

FIGS. 9, 10, and 11 illustrate the steps employed in attaching the card 50 of the preferred embodiment to the butterfly molded item 30. For the purpose of clarity, only the item half **32*b*** is shown in these figures.

As shown in FIG. 9, with the item 30 in its spread or opened configuration, and with the foldable attachment finger 66 of the card in its folded position (as shown in FIG. 8), the fixed attachment finger 64 of the card 50 is inserted under the integral hinge 34. The card 50 is then pivoted downwardly on the fixed finger 64, as shown in FIG. 10, until the edge of the item 30 that includes the hinge 34 is seated in the card notch 62. Then, as shown in FIG. 11, the foldable finger 66 is unfolded to its extended position (as shown in FIG. 7) under the integral hinge 34. The short vertical edge 76 between the angled edge 74 of the foldable finger 66 and the first horizontal linear crease 70 provides sufficient clearance for the foldable finger 66 to be extended under the hinge 34 without abrading against the hinge. Finally, as described above with reference to FIG. 5, the item halves **32*a*, 32*b* are folded together to capture the fingers 64, 66 between them, thereby securing the card 50 to the item 30. Once the card 50 is secured to the item 30, the card 50 can be folded and packed as described above with reference to FIGS. 3 and 4**.

From the foregoing description, it can be seen that the present invention offers the advantage of significant space savings during shipping and storage, as compared with conventional display cards, without compromising the primary function of displaying information about the product to which it is attached. In addition, the attachment fingers provide means, integral with the card, for self-attaching the card to the item to be displayed, without the need for additional, separate attachment devices or structures. Moreover, display cards in accordance with the present invention can be made easily and inexpensively, by simply altering the current conventional manufacturing process to include the steps of creating the creases and cutting the notch to form the attachment fingers.

It will be appreciated that a number of variations and modifications of the above-described embodiments will suggest themselves to those skilled in the pertinent arts. For example, as mentioned above, the card can be formed in a variety of shapes and sizes, to suit different needs and applications. Likewise, the card aperture can be made in different shapes and sizes, or it can be omitted altogether, as noted above. Similarly, the attachment fingers for removably attaching the card to the item may be assume a wide variety of forms to suit a similar variety of items. These and other variations and modifications that may suggest themselves should be considered within the spirit and scope of the present invention, as defined in the claims that follow.

What is claimed is:

1. A display card that is removably attachable to a butterfly-molded item, the item having an integral hinge joining a pair of molded item halves that are foldable along the hinge, the display card comprising:

a flat surface defining a top edge and a bottom edge;

hinge means, formed in the card near the bottom edge thereof, for allowing the card, when attached to the item, to be selectively folded from an unfolded configuration into a folded configuration in which a substantial portion of the flat surface overlies the item; and attachment means for removably attaching the card to the butterfly-molded item, comprising:

a pair of opposed, inwardly-pointed attachment fingers defined by a notch in the card that interrupts the bottom edge, the fingers being contiguous with the bottom edge, one of the fingers being a foldable finger that is foldable along an angled crease between a folded position directed away from the notch and an extended position directed toward the other finger, whereby, when the foldable finger is in its extended position, the fingers are disposed and oriented so as to be capable of being captured between the item halves under the integral hinge, with a portion of the item fitting in the notch when the item is folded with the fingers disposed between the item halves.

2. The display card of claim 1, wherein the hinge means comprises:

a first substantially linear crease formed in the card near and substantially parallel to the bottom edge; and a second substantially linear crease formed in the card near and substantially parallel to the first crease.

3. The display card of claim 1, wherein each of the fingers defines a portion of the bottom edge.

4. The display card of claim 2, wherein each of the fingers is defined between a portion of the bottom edge and a portion of the first crease.

5. The display card of claim 3, wherein the notch is substantially trapezoidal, with the fingers defining the non-parallel sides of the trapezoidal notch.

6. The display card of claim 4, wherein the notch is substantially trapezoidal, with the fingers defining the non-parallel sides of the trapezoidal notch.

7. The display card of claim 5, wherein the foldable finger has an angled edge that defines one non-parallel side of the trapezoidal notch when the foldable finger is in its extended position, and wherein the angled crease and the angled edge have coincident upper end points.

8. The display card of claim 7, wherein, when the foldable finger is in its folded position, the angled edge lies substantially parallel to the bottom edge of the card.

9. The display card of claim 6, wherein the foldable finger has an angled edge that defines one non-parallel side of the trapezoidal notch when the foldable finger is in its extended position, and wherein the angled crease and the angled edge have coincident upper end points.

10. The display card of claim 9, wherein the coincident upper end points of the angled crease and the angled edge are vertically spaced from the first crease by a short vertical edge.

11. The display card of claim 10, wherein, when the foldable finger is in the folded position, the angled edge lies substantially parallel to the first crease and is spaced from the first crease by approximately the length of the short vertical edge.

12. An improved display card for holding an item attached to the card for display, of the type including a flat surface defining a top edge and a bottom edge, wherein the item is a butterfly-molded item having an integral hinge joining a pair of molded item halves that are foldable along the hinge, wherein the improvement comprises:

a pair of opposed, inwardly-pointed attachment fingers defined by a notch in the card that interrupts the bottom edge, the fingers being contiguous with the bottom edge, one of the fingers being a foldable finger that is foldable along an angled crease between a folded position directed away from the notch and an extended position directed toward the other finger, whereby, when the foldable finger is in its extended position, the fingers are disposed and oriented so as to be capable of being captured between the item halves under the integral hinge, with a portion of the item fitting in the notch when the item is folded with the fingers disposed between the item halves.

13. The improved display card of claim 12, wherein each of the fingers defines a portion of the bottom edge.

14. The improved display card of claim 13, wherein the notch is substantially trapezoidal, with the fingers defining the non-parallel sides of the trapezoid notch.

15. The improved display card of claim 14, wherein the foldable finger has an angled edge that defines one non-parallel side of the trapezoidal notch when the foldable finger is in its extended position, and wherein the angled crease and the angled edge have coincident upper end points.

16. The display card of claim 15, wherein, when the foldable finger is in its folded position, the angled edge lies substantially parallel to the bottom edge of the card.

17. The improved display card of claim 12, wherein the improvement further comprises:

hinge means, formed in the card near the bottom edge thereof, for allowing the card, when attached to the item, to be selectively folded from an unfolded configuration into a folded configuration in which a substantial portion of the flat surface overlies the item.

18. The improved display card of claim 17, wherein the hinge means comprises:

a first substantially linear crease formed in the card near and substantially parallel to the bottom edge; and a second substantially linear crease formed in the card near and substantially parallel to the first crease.

19. The improved display card of claim 18, wherein each of the fingers is defined between a portion of the bottom edge and a portion of the first crease.

20. The improved display card of claim 19, wherein the notch is substantially trapezoidal, with the fingers defining the non-parallel sides of the trapezoidal notch.

21. The improved display card of claim 20, wherein the foldable finger has an angled edge that defines one non-parallel side of the trapezoidal notch when the foldable finger is in its extended position, and wherein the angled crease and the angled edge have coincident upper end points.

22. The improved display card of claim 21, wherein the coincident upper end points of the angled crease and the angled edge are vertically spaced from the first crease by a short vertical edge.

23. The improved display card of claim 22, wherein, when the foldable finger is in the folded position, the angled edge lies substantially parallel to the first crease and is spaced from the first crease by approximately the length of the short vertical edge.

24. An improved display card for holding an item attached to the card for display, of the type including a flat surface defining a top edge and a bottom edge, wherein the item is a butterfly-molded item having an integral hinge joining a pair of molded item halves that are foldable along the hinge, wherein the improvement comprises:

a pair of opposed, inwardly-pointed attachment fingers defined by a notch in the card that interrupts the bottom edge, the fingers being contiguous with the bottom edge, one of the fingers being a foldable finger that is foldable along an angled crease between a folded position directed away from the notch and an extended position directed toward the other finger, whereby, when the foldable finger is in its extended position, the fingers are disposed and oriented so as to be capable of being captured between the item halves under the integral hinge, with a portion of the item fitting in the notch when the item is folded with the fingers disposed between the item halves; and hinge means, formed in the card near the bottom edge thereof, for allowing the card, when attached to the item, to be selectively folded from an unfolded configuration into a folded configuration in which a substantial portion of the flat surface overlies the item.

25. The improved display card of claim 24, wherein the hinge means comprises:

a first substantially linear crease formed in the card near and substantially parallel to the bottom edge; and a second substantially linear crease formed in the card near and substantially parallel to the first crease.

26. The improved display card of claim 25, wherein each of the fingers is defined between a portion of the bottom edge and a portion of the first crease.

27. The improved display card of claim 24, wherein the notch is substantially trapezoidal, with the fingers defining the non-parallel sides of the trapezoid notch.

28. The improved display card of claim 24, wherein each of the fingers defines a portion of the bottom edge, and wherein the notch is substantially trapezoidal, with the fingers defining the non-parallel sides of the trapezoid notch.

29. The improved display card of claim 28, wherein the foldable finger has an angled edge that defines one non-parallel side of the trapezoidal notch when the foldable finger is in its extended position, and wherein the angled crease and the angled edge have coincident upper end points.

30. The improved display card of claim 29, wherein, when the foldable finger is in its folded position, the angled edge lies substantially parallel to the bottom edge of the card.

31. The improved display card of claim 26, wherein the foldable finger has an angled edge that defines one non-parallel side of the trapezoidal notch when the foldable finger is in its extended position, and wherein the angled crease and the angled edge have coincident upper end points.

32. The improved display card of claim 31, wherein the coincident upper end points of the angled crease and the angled edge are vertically spaced from the first crease by a short vertical edge.

33. The improved display card of claim 32, wherein, when the foldable finger is in the folded position, the angled edge lies substantially parallel to the first crease and is spaced from the first crease by approximately the length of the short vertical edge.

* * * * *